United States Patent [19]

Weidner

[11] 4,137,851

[45] Feb. 6, 1979

[54] ELECTRONIC IGNITION CIRCUIT

[75] Inventor: Peter F. Weidner, Breitenbrunn, Fed. Rep. of Germany

[73] Assignee: Diehl GmbH & Co., Nüremberg, Fed. Rep. of Germany

[21] Appl. No.: 849,267

[22] Filed: Nov. 7, 1977

[30] Foreign Application Priority Data

Nov. 25, 1976 [DE] Fed. Rep. of Germany ..... 2653517

[51] Int. Cl.[2] ..... F42C 11/06

[52] U.S. Cl. ..... 102/218; 102/220

[58] Field of Search ..... 102/218, 219, 220, 210, 102/207, 206

[56] References Cited

U.S. PATENT DOCUMENTS

| | | | |
|---|---|---|---|
| 3,548,749 | 12/1970 | Dreitzler | 102/220 |
| 3,732,823 | 5/1973 | Held et al. | 102/219 |
| 3,808,975 | 5/1974 | Stutzle et al. | 102/220 |

FOREIGN PATENT DOCUMENTS

| | | | |
|---|---|---|---|
| 1104397 | 4/1961 | Fed. Rep. of Germany | 102/218 |
| 1155037 | 9/1963 | Fed. Rep. of Germany | 102/218 |
| 1948382 | 4/1971 | Fed. Rep. of Germany | 102/219 |
| 2104422 | 8/1972 | Fed. Rep. of Germany | 102/218 |
| 2113126 | 8/1974 | Fed. Rep. of Germany | 102/210 |

*Primary Examiner*—Charles T. Jordan

*Attorney, Agent, or Firm*—Scully, Scott, Murphy & Presser

[57] ABSTRACT

An electronic ignition circuit for the self-destruction of a projectile fuse, including a voltage source and a charging condenser determinative of the time interval until self-destruction. A threshold switch is responsive to a predetermined minimum voltage at the charging condenser for igniting an igniter, and an electronic control circuit is connected between the voltage source and the charging condenser.

6 Claims, 3 Drawing Figures

ELECTRONIC IGNITION CIRCUIT

BACKGROUND OF THE INVENTION

1. Field of the Invention

The present invention relates to an electronic ignition circuit for the self-destruction of a projectile fuse with a voltage source and a charging condenser which determines the time interval until self-destruction whereby, after the reaching of a predetermined minimum voltage at the voltage potential pole of the charging condenser, there responds a threshold switch such as, for instance, a four-layer diode or a transistor circuit, and an igniter is ignited, and wherein an electronic control circuit is connected between the voltage potential pole of the voltage source and the voltage potential pole of the charging condenser.

2. Discussion of the Prior Art

Presently known from German Published Patent Specification No. 1,155,037, German Laid-open Patent Specification No. 2,113,126 and German Published Patent Specification No. 2,104,422 are circuits in which an ohmic resistor is located between the voltage potential pole of a voltage source constructed from a storage condenser or capacitor and the voltage potential pole of the charging condenser. This resistor, in conjunction with the charging condenser, determines the current and voltage cycle of the recharging sequence.

In the presently known circuits, towards the end of the recharging sequence preceding the actuation of the threshold switch, in effect, at only a still smaller potential difference between the voltage potential poles of the storage condenser and a charging condenser, there flows a correspondingly lesser current. This current must, however, be greater than the current flow which is necessary for the switching of the threshold switch, which is nevertheless low; however, must be available in each instance. For this purpose, the threshold value of the threshold switch must be reached at a voltage level at which a current flows which is still adequate for the switching: The dimensioning of the circuit pursuant to German Published Patent Specification No. 1,155,037 and the German Laid-open Patent Specification No. 2,113,126, and the selection of the components therein, are hereby set by narrowly confined limits.

In German Published Patent Specification No. 2,104,422, for the dependable initiation of the ignition of the igniter, even at low voltages and large time constants for the recharging sequence, there is proposed a feedback circuit. In this circuit a field effect transistor is located between the voltage potential poles of the storage condenser and the charging condenser, whose drain source section is coupled in feedback, by means of a repeating coil, to the gate electrode. However, the utilization of repeating coils is mostly undesirable, since these are relatively large and complex components.

SUMMARY OF THE INVENTION

Accordingly, it is an object of the present invention to propose an ignition circuit in which even a small potential difference between the voltage potential poles, towards the end of the recharging sequence, will with assurance lead the threshold switch to igniting of the igniter, without the need for employing a threshold switch with a low switching current or a repeating coil.

According to the present invention, the above-mentioned object is achieved in that the electronic control circuit is connected as a constant current source which will maintain essentially constant the charging current flowing from the voltage source to the charging condenser, respectively the threshold switch, independently of the differential voltage between the voltage potential poles which drops off during charging.

The invention is particularly advantageous when the voltage source is formed by a storage condenser or capacitance.

In presently known circuits, the switching time point to which the element is responsive must be so determined that the necessary switching current is produced from the dropping current dropping off at the recharging resistor. Since these, and therewith the charging current becomes smaller during the recharging sequence, the duration of the recharging sequence can only be partly employed as the delay time period until self-destruction. By means of the invention there can be attained an increase in the delay time period, since the voltage threshold value at which the threshold switch is actuated cannot be substantially lower than the maximum voltage of the charging condenser. At the switching time point, at which there is a small voltage difference between the storage condenser and the charging condenser, there flows a current which is adequate for switching, which is independent of the voltage difference. Hereby, it is not necessary to increase the ratio between the capacitance values of the storage condenser and the charging condenser. This ratio can be small, for example, up to two.

Since, in the invention, there flows at the switching time point an increased current in contrast with comparable known circuits, there is no need to select a component with threshold value relationships which operates with an especially low switching current. This, above all, has been found to be advantageous in the utilization of four-layer diodes, since these become much more expensive, the smaller their switching current.

In a preferred embodiment of the invention, the electronic control circuit is constituted of a field effect transistor and a resistor connected in series with the drain-source section of the former, whereby the resistor and the gate electrode are located at the voltage potential pole of the charging condenser, and the drain electrode, preferably across a compensating resistance, at the voltage potential pole of the storage condenser. By means of this circuit, which operates as a constant current source, the charging current is maintained constant. The circuit delivers the current flow for the component with threshold value relationships or ratios. When the foregoing is a four-layer diode, the charging current is then so adjusted through suitable dimensioning of the resistor, that it becomes higher than the switching current with respect to the leakage current of the charging condenser.

Preferably, the invention is utilized for an ignition circuit in which the component with threshold value ratios is located at the control electrode of a switching element connected in series with the igniter, preferably a thyristor, and the series circuit constituted of the igniter and switching element is located in parallel with the storage condenser.

BRIEF DESCRIPTION OF THE DRAWINGS

In following the detailed description there are disclosed exemplary embodiments of the invention, taken in conjunction with the accompanying drawings; in which.

DETAILED DESCRIPTION

Figure 1:
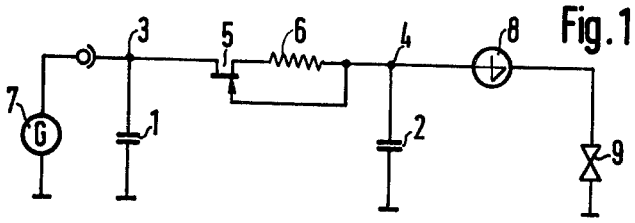
FIG. 1 illustrates an ignition circuit including a recharging network.

A recharging network of an ignition circuit encompasses a storage condenser or capacitance 1 and a recharging condenser 2. The voltage potential poles 3 and 4 of these condensers are connected through a series circuit, constituted of a field effect transistor 5 and a resistor 6. At the voltage potential pole 3 of the storage condenser 1 is a generator 7 which is effective for a short period upon firing of the projectile, the latter of which is provided with the ignition circuit. Located at the voltage potential pole 4 of the recharging condenser 2 is a component with threshold value ratios, which is formed by a four-layer diode 8. The four-layer diode 8 has an igniter 9 connected to the output thereof.

The drain electrode of the field effect transistor 5 is connected with the voltage potential pole 3, and its gate electrode is connected with the voltage potential pole 4. The source electrode is located at the resistor 6.

Figure 2:
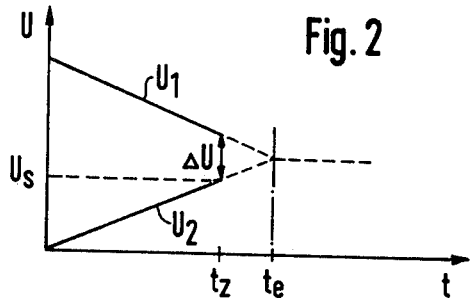
FIG. 2 shows a graphical representation of the voltage at the condensers of the recharging network.

When the storage condenser 1 is charged by the generator 7, there commences the recharging sequence. The recharging current flows through the drain source section of the field effect transistor 5 and the resistor 6 to the recharging condenser 2. The four-layer diode 8 is blocked. The recharging current is maintained constant through the intermediary of the circuit of the field effector transistor 5 which acts as a field effect-constant current source and by the resistor 6. In correspondence therewith, the voltage U1 at the storage condenser 1 reduces linearly. Correspondingly, the voltage U2 at the recharging condenser 2 increases linearly (compare FIG. 2). As soon as the threshold voltage Us of the four-layer diode 8 is reached at the voltage potential pole 4 of the recharging condenser 2, the diode is actuated and, at this time point tz the ignition takes place. The ignition time point tz lies only slightly ahead of the theoretical end te of the recharging sequence. Correspondingly small is the voltage difference U between the potentials of the voltage poles 3 and 4 at the ignition time point tz. The illustration according to FIG. 2 is generally diagrammatic. The differential voltage at the time point tz is larger than it would be for a cycle of the voltages U1 and U2 in accordance with an e-function, for corresponding time constants and at the same time point. Of extremely important significance for the invention is that the charging current does not drop off with the decreasing voltage difference. The current is so adjusted through suitable sizing of the resistor 6, that it is slightly larger than or equal to the sum of the switching current which is characteristic for the four-layer diode 8 and the leakage current of the recharging condenser 2. This will provide that, at the ignition time point tz, even when the latter is almost at the theoretical end te of the recharging sequence, current necessary for actuation of the four-layer diode 8 remains available.

Figure 3:
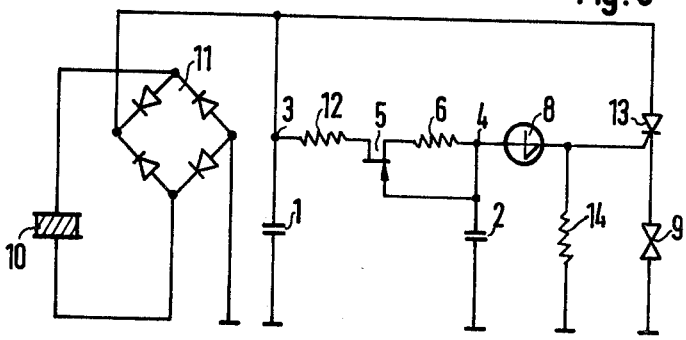
FIG. 3 illustrates a modified embodiment of an ignition circuit.

In the ignition circuit pursuant to FIG. 3, the generator is formed by a piezoelectric cell 10 and a full-wave rectifier 11. Through these, the positive as well as the negative half wave of the voltage which occurs at the cell 10 upon firing, respectively at the following discharge, is employed for the charging of the storage condenser 1. Connected to the field effect transistor 5 is a series resistor 12 which serves for the limitation of the current magnitude which is encountered by the field effect transistor upon actuation thereof. The output of the four-layer diode 8 is connected to the control electrode of a thyristor 13 and to a resistor 14. The anode of the thyristor 13 is connected to the voltage potential pole 3 of the storage condenser 1. Connected to the cathode thereof is the igniter 9.

When the storage condenser 1 is charged from the cell 10 through the rectifier 11, there commences the above-described recharging sequence. After about 5 seconds there is reached the threshold value of the four-layer diode 8. In that manner, there is ignited the thyristor 13. The storage condenser 1 discharges through the igniter 9, whereupon there results the self-destruction of the projectile.

The invention is not limited to the described embodiment, but can also be utilized with ignition circuits which, in lieu of the storage condenser, operate with a battery.

What is claimed is:

1. In an electronic ignition circuit for the self-destruction of a projectile fuse, including a voltage source, a charging condenser for determining the time interval for self-destruction, a threshold switch actuatable upon a predetermined minimum voltage being reached at the voltage potential pole of said charging condenser so as to ignite an igniter; and an electronic control circuit being connected intermediate the voltage potential pole of said voltage source and the voltage potential pole of said charging condenser, the improvement comprising: said electronic control circuit being connected in said ignition circuit to provide a constant current source for maintaining the recharging current flowing from said voltage source to said charging condenser and to said threshold switch essentially constant independently of the drop in the differential voltage between said voltage potential poles during charging.

2. A circuit as claimed in claim 1, said threshold switch comprising a four-layer diode.

3. A circuit as claimed in claim 1, said threshold switch comprising a transistor circuit.

4. A circuit as claimed in claim 1, said voltage source comprising a storage condenser.

5. A circuit as claimed in claim 1, said constant current source comprising a field effect transistor, and a resistor connected in series with the drain-source section of said transistor, said resistor and the gate electrode of said transistor being connected to the voltage potential pole of said charging condenser, and the drain electrode of said transistor being connected to the voltage potential pole of said storage condenser.

6. A circuit as claimed in claim 5, comprising a series resistor connected intermediate said drain electrode and said storage condenser.

* * * * *